US006279849B1

(12) United States Patent
Martin

(10) Patent No.: US 6,279,849 B1
(45) Date of Patent: Aug. 28, 2001

(54) MAGNETIC CHUCK FOR UNWINDING OF WIRE FROM A SPOOL

(75) Inventor: Joseph Marion Martin, Monroe, NC (US)

(73) Assignee: McCoy-Ellison, Inc., Monroe, NC (US)

( * ) Notice: Subject to any disclaimer, the term of this patent is extended or adjusted under 35 U.S.C. 154(b) by 0 days.

(21) Appl. No.: 09/443,974

(22) Filed: Nov. 19, 1999

(51) Int. Cl.[7] ..... B65H 23/06

(52) U.S. Cl. ..... 242/422.8; 242/597.6; 242/599.4

(58) Field of Search ..... 242/422.4, 422.2, 242/422.8, 597.6, 599.4, 156.2

(56) References Cited

U.S. PATENT DOCUMENTS

| | | | | |
|---|---|---|---|---|
| 969,529 | | 9/1910 | Donnelly . | |
| 1,506,890 | | 9/1924 | Duncan . | |
| 2,034,862 | | 3/1936 | Dunham . | |
| 2,134,994 | * | 11/1938 | Zarafu | 242/422.8 X |
| 2,179,334 | * | 11/1939 | Keyes | 242/422.2 X |
| 2,904,277 | * | 9/1959 | Underwood | 242/597.6 |
| 2,923,493 | * | 2/1960 | Fitzgerald et al. | 242/422.2 X |
| 2,998,878 | * | 9/1961 | Biedinger et al. | 242/597.6 X |
| 3,036,785 | * | 5/1962 | Rossi | 242/597.6 |
| 3,134,556 | | 5/1964 | Wasson . | |
| 3,224,702 | | 12/1965 | Jones et al. . | |
| 4,458,857 | | 7/1984 | Moore et al. . | |
| 4,929,012 | | 5/1990 | Slezak | 294/86.41 |
| 5,024,477 | | 6/1991 | Slezak | 294/81.2 |
| 5,163,727 | | 11/1992 | Slezak et al. | 294/81.2 |
| 5,938,142 | * | 8/1999 | Halperin | 242/599.4 X |
| 5,967,445 | * | 10/1999 | Yuyama et al. | 242/597.6 |
| 6,059,222 | * | 5/2000 | Yuyama et al. | 242/597.6 X |
| 6,065,716 | * | 5/2000 | Munster | 242/597.6 |
| 6,092,755 | * | 7/2000 | Konishi et al. | 242/422.4 X |

* cited by examiner

*Primary Examiner*—William A. Rivera
(74) *Attorney, Agent, or Firm*—Kennedy Covington Lobdell & Hickman, LLP

(57) ABSTRACT

A coupling between a spool and a brake drum includes: a metallic base having a first axial opening formed therein for extension of a spindle therethrough; a metallic rim disposed about the first axial opening and integral with and extending in a generally axial direction from the base, with the rim including an edge having a discontinuous planar surface disposed substantially orthogonal to the axial direction; and a magnet integral with the base that magnetizes the discontinuous planar surface of the rim of the magnetic chuck. The edge has a stepped profile resembling a rectangular wave; the rim is circular and coaxial with the axial opening in the base; and the magnet includes a second opening formed in register with the first opening in the base for extension of the spindle therethrough. The magnetic chuck is disposed on the spindle between the spool and the brake drum. The magnetic chuck is secured by fasteners to the brake drum for rotation therewith about an axis of the spindle. The discontinuous planar surface of the edge of the magnetic chuck extends between ribs formed in an end surface of the spool into magnetic engagement with the end surface of the spool disposed between the ribs. The magnetic chuck thereby magnetically couples the spool to the brake drum for direct rotation therewith with improved resistance to slippage of the spool relative to the magnetic chuck.

20 Claims, 5 Drawing Sheets

58
78
80
56
98
54
82
90
84
88
92
76
66
60
74
60
70
72
68
64
52

MAGNETIC CHUCK FOR UNWINDING OF WIRE FROM A SPOOL

FIELD OF THE PRESENT INVENTION

The present invention relates to the unwinding of wire from a spool and, in particular, to an improved coupling between the spool and a brake drum of an unwinding machine which resists slippage of the spool relative to the brake drum in the circumferential direction during unwinding.

BACKGROUND OF THE INVENTION

Wire is unwound from a spool in many industrial manufacturing operations. Thus, for example, in the manufacture of steel belted radial tires, a plurality of wires 10 are drawn off from an array 12 of spools 14 supported on support frames 16 of an unwinding machine 18 as shown in FIG. 1. The wires 10 drawn from the spools 14 are then transferred to a calender for combination with rubber prior to a vulcanizing process (not shown).

During the drawing of the wires 10 from the array 12 of spools 14 shown in FIG. 1, it is desirable to control the tension applied in the wires 10, with the degree of tension depending in part upon the gauge of the wire being drawn. Thus, for example, in the manufacture of steel belted radial tiers for small cars, tension upwards of 0.1836 Newtons (i.e., "1.8 Kg") is desirable. However, in the manufacture of earth moving vehicular tires utilizing ⅜ in. diameter wire, tension upwards of 0.9180 Newtons (i.e., "9 Kg") is desirable.

A conventional method utilizes a magnetic chuck 20 as shown in FIG. 2 for the coupling of a spool 14 to a brake drum 22 of an unwinding machine 18 as shown in FIG. 1. During the unwinding process, selective braking of the brake drum 22 results in the application of the desired tension in the wire 10 that is drawn from the spool 14.

The conventional magnetic chuck 20 shown in FIG. 2 includes a magnet 24 disposed within a disc-like housing 26 including a lip 28 having a continuous planar surface 30 generally transverse to an axis 32 of a spindle 34 upon which it is rotatably supported. The spool 14 includes opposed identical ends 36 each having a plurality of radial ribs 38 formed in an end surface 40 for strengthening of the end 36 of the spool 14. A circular recess 42 is also defined by the end 36 of the spool 14 having a generally planar, annular surface 44 surrounding an axial passage 46 that extends through the center of the spool 14. The spool 14 is rotatably supported on the spindle 34 by extension of the spindle 34 through this passage 46.

The magnetic chuck 20 is secured to the brake drum 22 by conventional fasteners 48. The magnet 24 itself is adhered to a base 50 of the housing 26 using an adhesive. The lip 28 of the housing 26 extends axially away from the base 50 to surround the magnet 24. The magnet 24 magnetizes the continuous planar surface 30 of the lip 28.

The spool 14 is secured to the magnetic chuck 20 by magnetic engagement between the planar surface 30 of the lip 28 and the annular planar surface 44 of the recess 42 formed in the end 36 of the spool 14.

The arrangement of FIG. 2 performs well in the manufacture of steel belted radial tires in which the tension in the wires does not exceed approximately 0.1836 Newtons ("1.8 Kg"). However, once this upper limit is exceeded, the spool 14 retained simply through magnetic attraction against the planar surface 30 begins to slip thereon. Consequently, tension in the range of 0.9180 Newtons ("9 Kg")cannot be achieved using this conventional arrangement.

A known solution for achieving the higher desired tension includes the provision of a pin on the brake drum which extends within a bore of the spool for locking engagement therewith (not shown), whereby the spool would be physically precluded from rotating relative to the brake drum without first severing or bending of the locking pin. While such an arrangement is effective in achieving the desired tension, play between the pin and the bore in the spool leads to clanking and other undesirable noise during rotation of the spool in unwinding of the wire. Moreover, when a large plurality of spools simultaneously are being unwound as shown in FIG. 1, the noise becomes so great that ear protection must be worn by an operator attending to the unwinding machine.

Another disadvantage to this arrangement is that in the loading of a new spool of wire onto a spindle of the support frame, the bore in the side of the spool must be aligned with the locking pin disposed on the side of the brake drum for proper positioning of the spool on the spindle. While this may not be exceptionally tedious for the loading of a single spool, this task is impractical with a large array of spools as shown in FIG. 1.

Yet a third disadvantage to this arrangement is that during rotation of the spool on the spindle, the spindle tends to move away from the brake drum off of the locking pin and, consequently, an operator must constantly monitor the array of spools to insure that each is properly maintained in position on its spindle.

In view of the above conventional arrangements for unwinding wire from spools, it is clear that a need exists for an improved apparatus and method by which higher levels of tension easily exceeding 0.1836 Newtons ("1.8 Kg")can be achieved without encountering the foregoing disadvantages.

SUMMARY OF THE INVENTION

Briefly summarized, the present invention relates to a coupling between a spool of wire and a brake drum on an unwinding machine. The coupling is accomplished by a magnetic chuck which, in accordance with the present invention, includes: (1) a metallic base having a first axial opening formed therein for extension of a spindle therethrough; (2) a metallic rim disposed about the first axial opening and integral with and extending in a generally axial direction from the base, with the rim including an edge having a discontinuous planar surface disposed substantially orthogonal to the axial direction; and (3) a magnet integral with the base that magnetizes the discontinuous planar surface of the rim.

Features of the magnetic chuck of the present invention include: the edge having a stepped profile resembling a rectangular wave; the rim being circular and coaxial with the axial opening in the base; and, the magnet including a second opening formed in register with the first opening in the base for extension of the spindle therethrough.

The apparatus for unwinding of wire from a spool in accordance with the present invention includes a spindle associated therewith that is disposed in a generally horizontal orientation on a support frame. The spool includes opposed ends and defines an axial opening therebetween through which the spindle extends for rotatable support of the spool on the spindle. An end of the spool is metallic and includes ribs formed in an end surface thereof for reinforcement of the end of the spool. A shaft collar preferably comprising a brake drum defines an opening through which the spindle also extends for support thereof on the spindle, with the brake drum being disposed between the spool and the support frame.

In accordance with the present invention, the magnetic chuck is disposed about the spindle between the spool and the brake drum. In particular, the magnetic chuck is secured by fasteners to the brake drum for rotation therewith about an axis of the spindle. Furthermore, the discontinuous planar surface of the edge of the magnetic chuck extends between the ribs of the spool into abutment with the end surface of the spool that is disposed between the ribs. The magnetic chuck thereby magnetically engages the metallic end of the spool and couples the spool to the brake drum for rotation therewith about the spindle.

The magnetic engagement of the spool between the ribs has been found to improve resistance to slippage of the spool in a circumferential direction relative to the magnetic chuck and the brake drum. Consequently, greater tension may be applied to wire being unwound from the spool compared with the tension that may be applied through the aforesaid conventional magnetic chuck of FIG. 2.

In addition to the apparatus, the present invention also includes a method for increasing the resistance of a spool to slippage relative to a magnetic chuck during unwinding of wire therefrom, which method is used in conjunction with the apparatus of the present invention. The method includes the steps of: (1) securing the magnetic chuck to the brake drum disposed on the spindle of the unwinding machine; (2) disposing the spool on the spindle, the spool including an end thereof having ribs formed therein for reinforcement of the end of the spool; and (3) coupling the spool to the brake drum through engagement of the magnetic chuck with the end of the spool, the magnetic chuck engaging the end of the spool between the ribs formed in the spool.

BRIEF DESCRIPTION OF THE DRAWINGS

For further understanding of the present invention, a preferred embodiment thereof will now be described in detail with reference to the accompanying drawings, wherein.

DETAILED DESCRIPTION OF A PREFERRED EMBODIMENT

Figure 1:
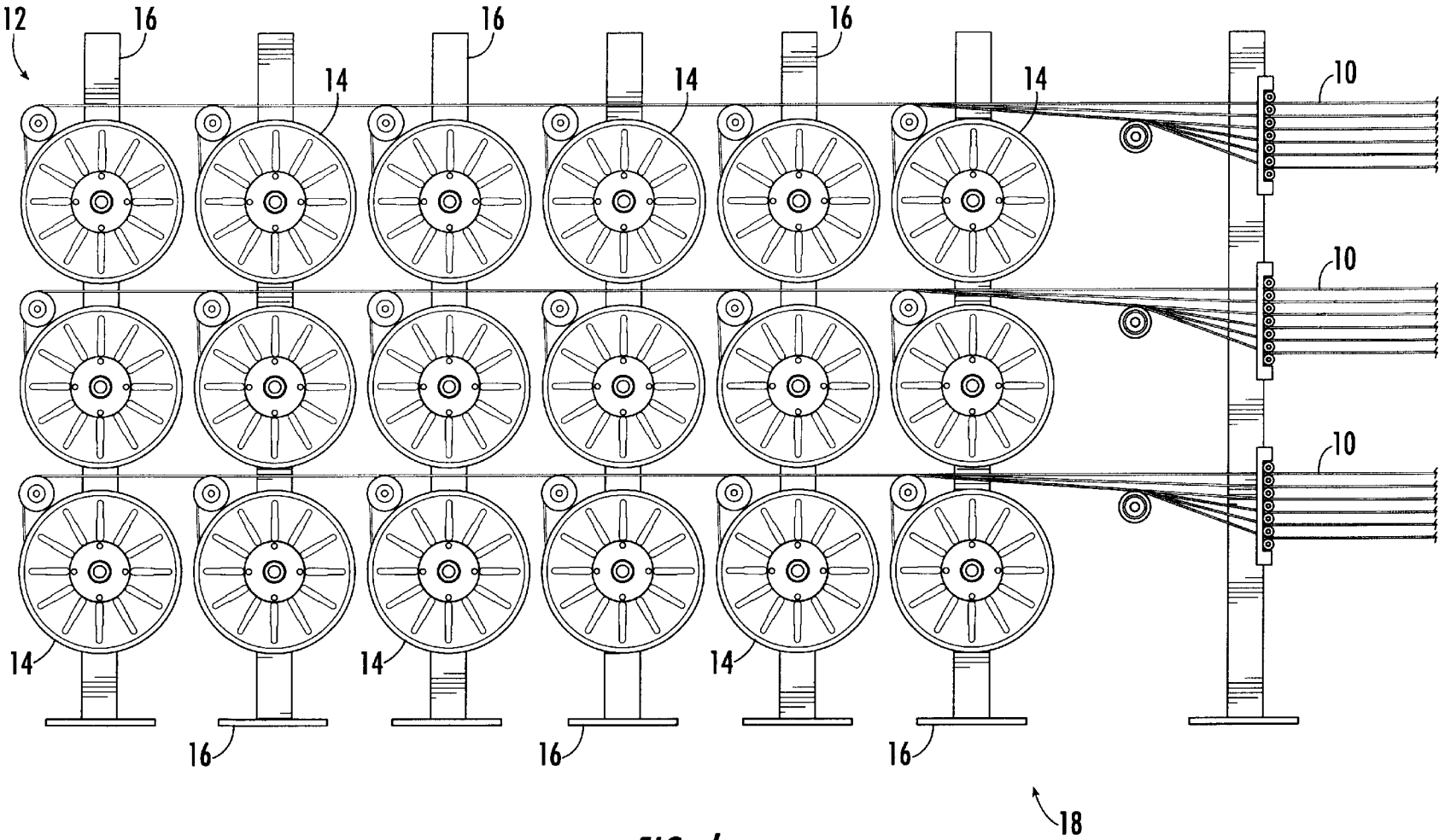
FIG. 1 is an elevational, environmental view of an unwinding apparatus.

Referring now to FIGS. 3–8, the spool 52, magnetic chuck 54, spindle 56, and brake drum 58 of the preferred apparatus are shown in an exploded view of a portion of the winding machine in accordance with the present invention. In particular, the spool 52 is formed from metal and includes opposed identical ends 60 and an intermediate cylindrical portion 64 extending therebetween. Furthermore, the cylindrical portion 64 includes an outer diameter D (see FIG. 8) upon which wire is wound for storage.

Each end 60 of the spool 52 includes an end surface 66 having ribs 68 formed therein that project outwardly from the spool 52, the ribs 68 preferably comprising raised ridges. The ribs 68 are oriented with respect to one another about an axial passage 70 defined by the intermediate cylindrical portion 64 of the spool 52. The ribs 68 converge to a circular recess 72 formed in the end 60 of the spool 52 and the end surface 74 disposed within the circular recess 72 is generally planar.

Figure 3:
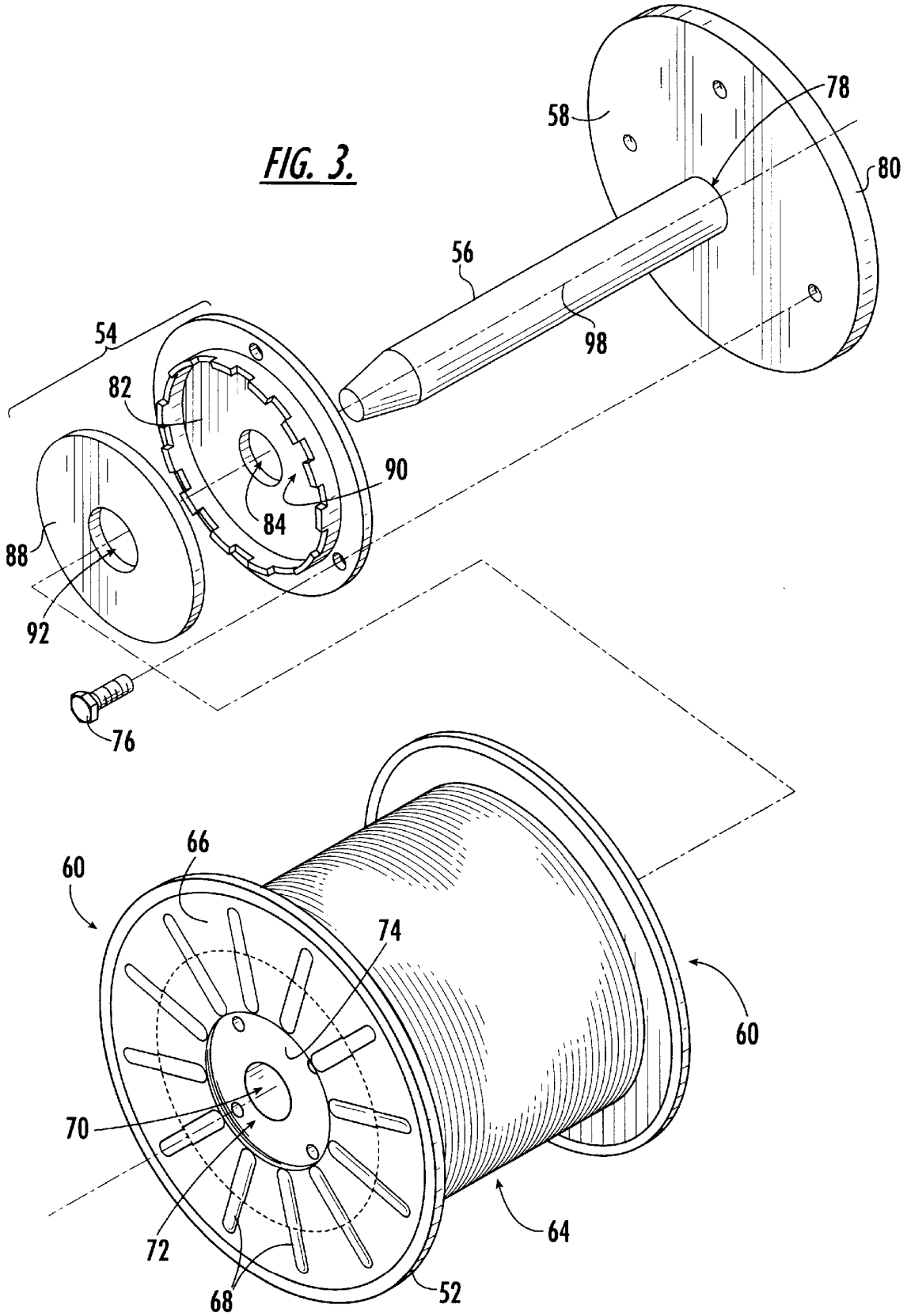
FIG. 3 is an exploded view in perspective of a portion of the unwinding apparatus of FIG. 1 in accordance with the present invention.
Figure 4:
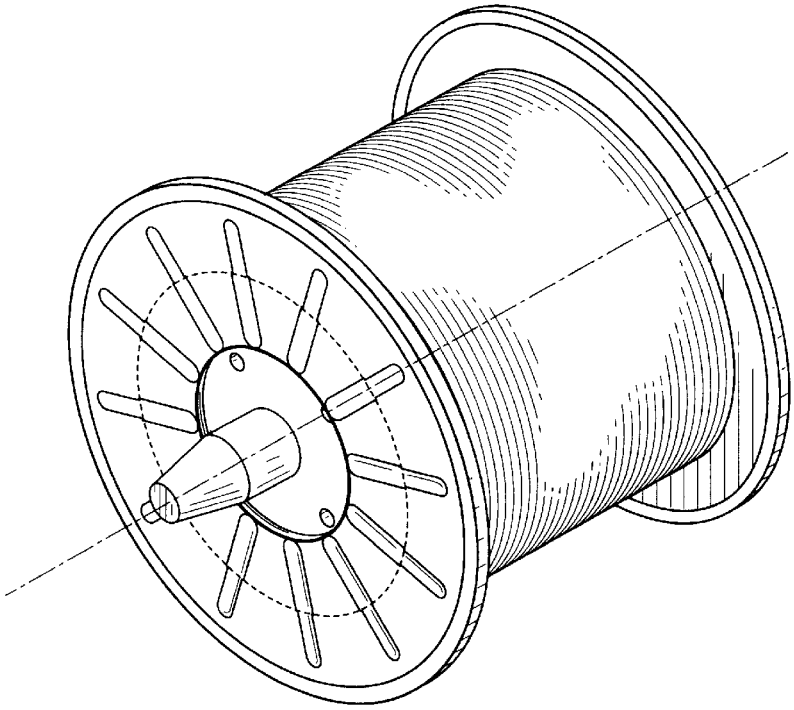
FIG. 4 is a perspective view of the portion of the unwinding apparatus of FIG. 3.

The spool 52 is supported on the unwinding machine by extension of the spindle 56 through the axial passage 70. The spool 52 is retained on the spindle 56 by the magnetic chuck 54 which, itself, is secured by three fasteners 76 (one of which is shown in FIG. 3) to the brake drum 58. The brake drum 58, in turn, includes an axial opening 78 through which the spindle 56 extends and, further, includes a circumferential edge 80 about which a band brake (not shown) is disposed for selective braking of the drum brake 58 during winding. The spool 52 installed on the spindle 56 and retained by the magnetic chuck 54 to the brake drum 58 is shown in FIG. 4.

Figure 2:
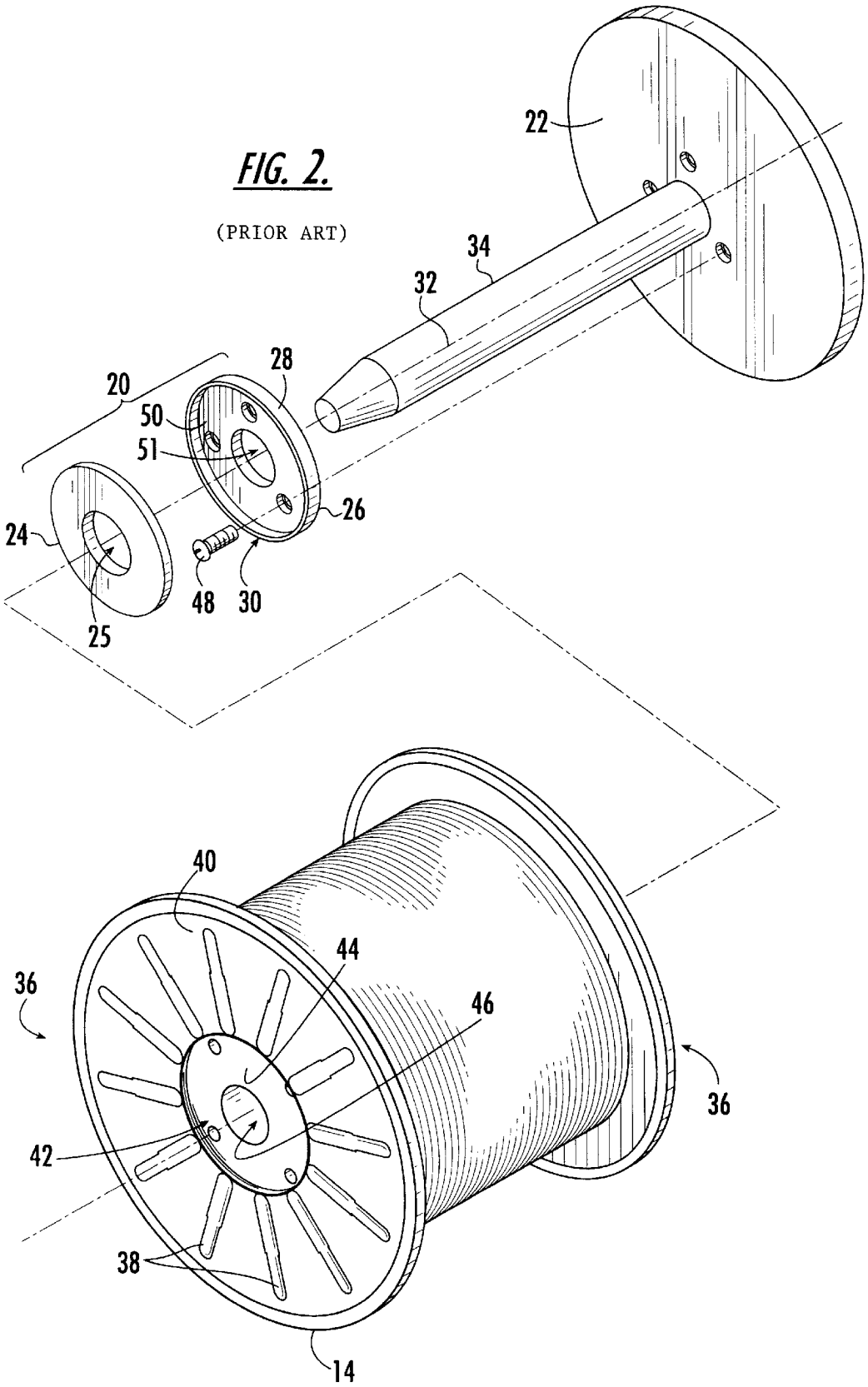
FIG. 2. (PRIOR ART)
FIG. 2 is an exploded view in perspective of a portion of the unwinding apparatus of FIG. 1 in accordance with the prior art.

The magnetic chuck 54 includes a metallic base 82 having an axial opening 84 through which the spindle 56 extends. The axial opening 84 preferably is identical to the axial opening 51 of the conventional magnetic chuck 20 shown in FIG. 2, whereby the conventional magnetic chuck 20 is readily replaceable by the magnetic chuck 54 in accordance with the present invention.

The magnetic chuck 54 additionally includes a metallic, circular rim 86 integral with the base 82 and disposed coaxially about the axial opening 84 in the base 82. A magnet 88 is adhered to the base 82 within an interior space 90 defined by the rim 86. The magnet 88 also includes an axial opening 92 coaxial to and in registry with the axial opening 84 in the base 82. Again, the axial opening 92 is identical to the axial opening 25 defined by the magnet 24 in the conventional magnetic chuck 20 of FIG. 2 for ready substitution thereof.

Figure 5:
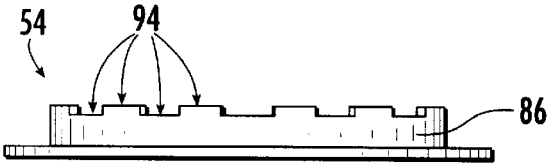
FIG. 5 is an elevational view of the magnetic chuck of the unwinding apparatus of FIG. 3.
Figure 6:
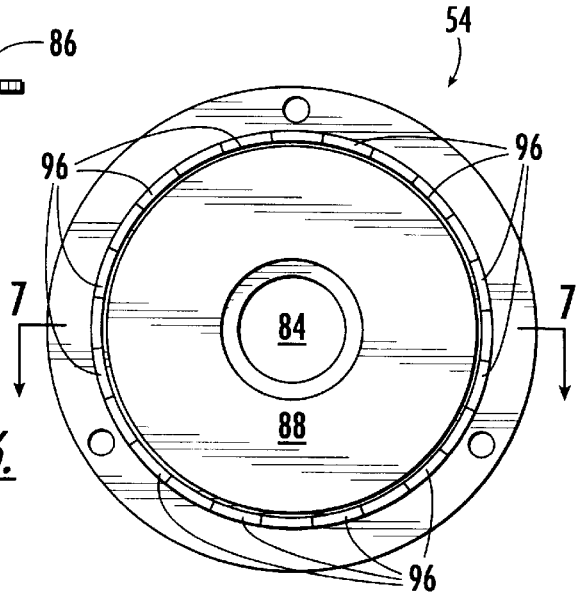
FIG. 6 is a plan view of the magnetic chuck of FIG. 5.
Figure 7:
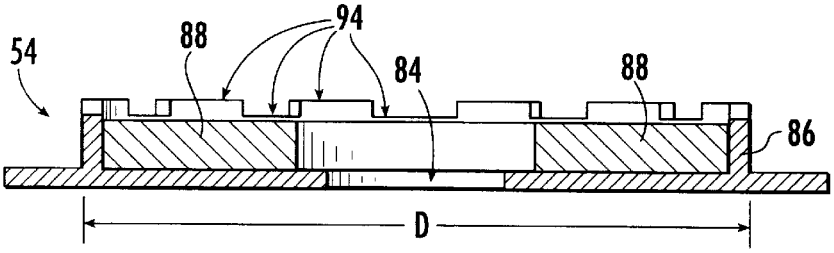
FIG. 7 is a cross-sectional view of the magnetic chuck of FIG. 6 taken along the line 7—7.

The rim 86 of the magnetic chuck 54 extends generally axially from the base 82 toward the spool 52 and includes an edge 94 thereof having a discontinuous planar surface 96 disposed substantially orthogonal to an axis 98 of the spindle 56. Indeed, the edge 94 includes a stepped profile resembling a rectangular wave as shown in FIGS. 5 and 7.

Figure 8:
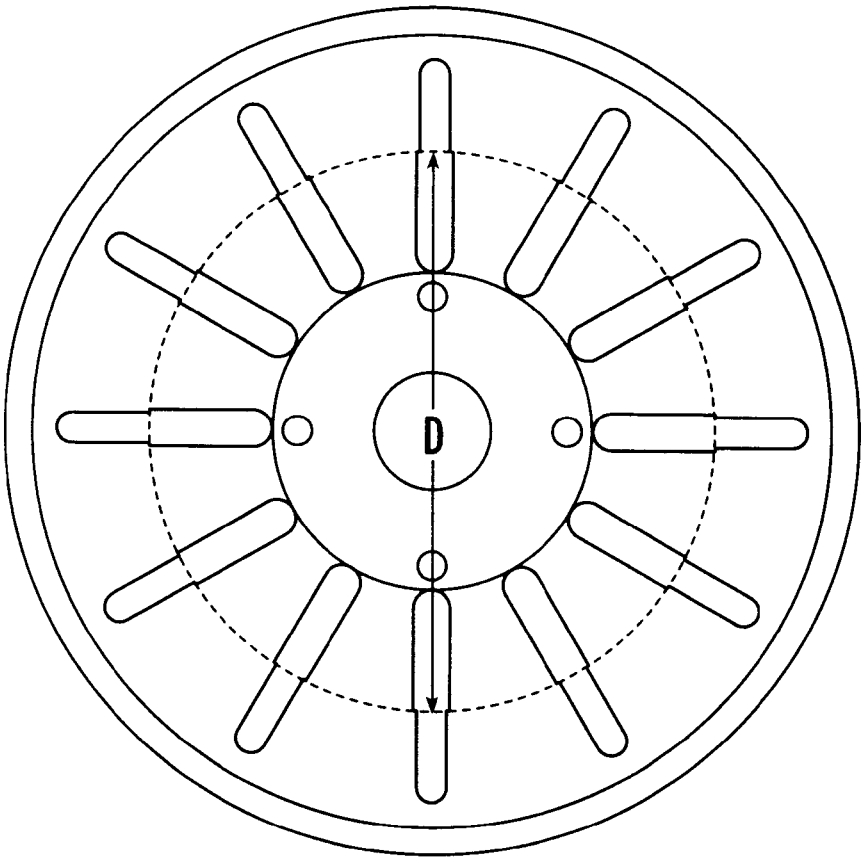
FIG. 8 is a plan view of the side of the spool of FIG. 3.

The rim 86 of the magnetic chuck 54 includes a diameter D corresponding to the outer diameter D of the intermediate portion 64 of the spool 54 as shown in FIGS. 3, 4 and 8 such that, when disposed in adjacent abutting relation on the spindle 56, the edge 94 of the rim 86 engages the end 60 of the spool 52 immediately adjacent the end of the intermediate portion 64. Furthermore, in accordance with the present invention, the discontinuity in the planar surface 96 of the edge 94 of the rim 86 permits the discontinuous planar surface 96 to extend between the radially extending ribs 68 formed in the end 60 of the spool 52 into abutting, magnetic engagement with the planar end surface 66 of the spool 52 located between the ribs 68. The magnetic chuck 54 does not engage the end surface 74 of the spool 52 within the recess 72 as found in the conventional arrangement shown in FIG. 2.

In this disposition of the magnetic chuck 54 relative to the spool 52 on the spindle 56, magnetic forces transmitted through the metallic base 82 and rim 86 of the magnetic chuck 54 pass through the planar surface 96 of the edge 94 of the rim 86 into the planar end surface 66 of the spool 52 to securely retain the spool 52 in engagement with the magnetic chuck 54 and drum brake 58.

It has been found that the aforesaid arrangement greatly increases the tension that can be applied in wire being unwound from the spindle 52. The disposition of the rim 86 of the magnetic chuck 54 in magnetic engagement with the end surface 66 of the spool 52 between the raised ribs 68 of the end 60 of the spool 52 permit tension of approximately 0.9180 Newtons ("9 Kg") and more to be applied to the wire without slippage of the spool 52 in a circumferential direction relative to the magnetic chuck 54 and the braking drum 58. Moreover, if excessive tension is applied to the wire, the discontinuous planar surface 96 of the edge 94 of the rim 86 of the magnetic chuck 54 will ride up the raised ribs 68 displacing the spool 52 along the spindle 56 away from the brake drum 58 and, consequently, will not damage the coupling mechanism as in the conventional arrangement wherein the locking pin is bent or severed.

As will now be apparent, when installing the spool 52 on the spindle 56 in secure attachment to the magnetic chuck 54, the spool 52 only need be pushed in sliding engagement on the spindle 56 into contact with the rim 86 of the magnetic chuck 54 and slightly rotated to orient the edge 94 of the rim 86 between the ribs 68 formed in the end 60 of the spool 52, whereby the discontinuous planar surface 96 of the edge 94 of the rim 86 can be further extended past the raised ribs 68 and into contact with the end surface 66 of the spool 52 located between the raised ribs 68.

In view of the aforesaid written description of the present invention including the detailed description of a preferred embodiment, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention.

Accordingly, while the present invention has been described herein in detail in relation to a preferred embodiment, it is to be understood that this disclosure is only illustrative and exemplary of the present invention and is made merely for purposes of providing a full and enabling disclosure of the invention. The foregoing disclosure is not intended nor to be construed to limit the present invention or otherwise to exclude any such other embodiments, adaptations, variations, modifications and equivalent arrangements, the present invention being limited only by the claims appended hereto and the equivalents thereof.

Thus, for example, while the present invention has been discussed with regard to the unwinding of wire from a spool, the magnetic chuck in accordance with the present invention equivalently could be used in controlling tension in a wire during winding of the wire onto the spool. Indeed, the magnetic chuck of the present invention could be used in any spool winding or unwinding process.

What is claimed is:

1. A magnetic chuck for retention of a spool during unwinding of wire, comprising:

a) a metallic base having a first axial opening formed therein for extension of a spindle therethrough;

b) a metallic rim disposed about said first axial opening and integral with and extending in a generally axial direction from said base, said rim including an edge having a discontinuous planar surface disposed substantially orthogonal to said axial direction; and c) a magnet integral with said base magnetizing said discontinuous planar surface.

2. The magnetic chuck of claim 1, wherein said edge has a stepped profile resembling a rectangular wave.

3. The magnetic chuck of claim 1, wherein said rim is circular and coaxial with said axial opening.

4. The magnetic chuck of claim 1, wherein said magnet includes a second opening formed therein in register with said first opening in said base for extension of a spindle therethrough.

5. An apparatus for unwinding of wire, comprising:

a) a spindle disposed on a support frame;

b) a spool having opposed ends and defining an opening therebetween through which said spindle extends for support of said spool on said spindle, a said end of said spool being metallic and having ribs formed in an end surface thereof for reinforcement of said end of said spool;

c) a collar disposed about said spindle between said spool and said support frame; and d) a magnetic chuck disposed about said spindle between said spool and said collar, said magnetic chuck being integral with said collar and having an edge, a portion of which extends between said ribs of said spool into abutting, magnetic engagement with said end surface of said spool between said ribs, said magnetic engagement of said spool between said ribs resisting slippage of said spool in a circumferential direction.

6. The apparatus of claim 5, wherein said collar includes a circumferential edge for selective braking of said collar by a brake band whereby selective breaking of said collar, integral chuck, and magnetically engaged spool during unwinding results in selective application of tension in a wire being unwound.

7. The apparatus of claim 5, wherein said edge of said magnetic chuck includes a stepped profile resembling a rectangular wave.

8. The apparatus of claim 5, wherein said portion of said edge engaging said end surface of said spool between said ribs comprises a discontinuous planar surface disposed substantially orthogonal to an axis of said spindle.

9. The apparatus of claim 5, wherein said ribs extend radially relative to said axis of said spindle.

10. The apparatus of claim 5, wherein said spool includes an intermediate cylindrical portion having an outer diameter onto which wire is wound, and wherein said rim of said magnetic chuck is circular with a diameter approximately equal to said outer diameter of said cylindrical portion.

11. An apparatus for unwinding of wire, comprising:

a) a spindle disposed in a generally horizontal orientation on a support frame;

b) a spool having opposed ends and defining an axial opening therebetween through which said spindle extends for rotatable support of said spool on said spindle, a said end of said spool being metallic and having ribs formed in an end surface thereof for reinforcement of said end of said spool;

c) a brake drum defining an opening through which said spindle extends for disposition thereof on said spindle; and d) a magnetic chuck defining an opening through which said spindle extends for disposition thereof on said spindle, said magnetic chuck being secured to said brake drum for rotation therewith about an axis of said spindle and having an edge with a discontinuous planar surface substantially orthogonal to an axis of said spindle, said discontinuous surface of said edge extending between said ribs of said spool into abutting, magnetic engagement with a portion of said end surface of said spool disposed between said ribs, said magnetic chuck magnetically coupling said spool to said brake drum for rotation therewith about said spindle axis, said magnetic engagement of said spool between said ribs resisting slippage of said spool in a circumferential direction.

12. The apparatus of claim 11, wherein said ribs extend outwardly from said spool toward said magnetic chuck.

13. The apparatus of claim 11, wherein said edge of said magnetic chuck includes a stepped profile resembling a rectangular wave.

14. The apparatus of claim 11, wherein said spool includes an intermediate cylindrical portion having an outer diameter onto which wire is wound, and wherein said rim of said magnetic chuck is circular with a diameter approximately equal to said outer diameter of said cylindrical portion.

15. A method for increasing the resistance of a spool to slippage relative to a magnetic chuck during winding and unwinding of wire therefrom, comprising the steps of:

a) securing the magnetic chuck to a brake drum disposed on a spindle of an unwinding machine;

b) disposing the spool of wire to be unwound on the spindle, the spool including an end thereof having ribs formed therein for reinforcement of the end of the spool; and c) coupling the spool to the brake drum through engagement of the magnetic chuck with the end of the spool, the magnetic chuck engaging in magnetic retention the end of the spool between the ribs thereof.

16. The method of claim 15, wherein only the magnetic chuck engages and couples the spool to the brake drum.

17. The method of claim 15, wherein the magnetic chuck engages the spool only between the ribs thereof.

18. The method of claim 15, wherein the magnetic chuck includes a rim having an edge with a discontinuous planar surface substantially orthogonal to an axis of the spindle, the discontinuous surface of the edge extending between the ribs of the spool into abutting, magnetic engagement with the spool between the ribs thereof.

19. The method of claim 18, wherein the ribs of the spool extend outwardly therefrom, and wherein said step of coupling the spool to the brake drum comprises merely pushing the spool on the spindle toward the magnetic chuck while rotating the spool whereby the discontinuous planar surface of the edge of the magnetic chuck becomes disposed between the ribs of the spool and engages the end of the spool therebetween.

20. The method of claim 18, wherein the spool includes an intermediate cylindrical portion having an outer diameter for carrying the wire, and wherein the rim of the magnetic chuck is circular with a diameter approximately equal to the outer diameter of the cylindrical portion.

* * * * *